US006422985B1

(12) United States Patent
Heitmann

(10) Patent No.: US 6,422,985 B1
(45) Date of Patent: Jul. 23, 2002

(54) ROLLER-BORNE PRESSURE ROLLER FOR TEXTILE MACHINES, ESPECIALLY TEXTURING MACHINES

(75) Inventor: Uwe Heitmann, Goeppingen (DE)

(73) Assignee: TEXParts GmbH, Stuttgart (DE)

( * ) Notice: Subject to any disclaimer, the term of this patent is extended or adjusted under 35 U.S.C. 154(b) by 0 days.

(21) Appl. No.: 09/424,395

(22) PCT Filed: Mar. 27, 1999

(86) PCT No.: PCT/EP99/02123

§ 371 (c)(1),
(2), (4) Date: Nov. 22, 1999

(87) PCT Pub. No.: WO99/54531

PCT Pub. Date: Oct. 28, 1999

(30) Foreign Application Priority Data

Apr. 21, 1998 (DE) ..... 198 17 741

(51) Int. Cl.[7] ..... B25F 5/02
(52) U.S. Cl. ..... 492/16; 492/47; 492/45
(58) Field of Search ..... 492/47, 21, 16, 492/45; 29/898.07

(56) References Cited

U.S. PATENT DOCUMENTS

| | | | | | |
|---|---|---|---|---|---|
| 3,447,184 | A | * | 6/1969 | McGinley | 492/21 |
| 4,852,230 | A | * | 8/1989 | Yu | 29/898.07 |
| 5,099,559 | A | * | 3/1992 | McGrath | 492/16 |
| 5,144,743 | A | * | 9/1992 | Kempas | 29/898.09 |
| 5,267,932 | A | | 12/1993 | Grant | |
| 5,451,197 | A | * | 9/1995 | Grant | 492/16 |
| 5,722,167 | A | * | 3/1998 | Duchamp et al. | 29/898.061 |
| 6,112,411 | A | * | 9/2000 | Rutter | 29/898.07 |

FOREIGN PATENT DOCUMENTS

| | | |
|---|---|---|
| DE | 44 08 552 A1 | 1/1995 |
| GB | 906198 | 9/1962 |

* cited by examiner

*Primary Examiner*—I Cuda-Rosenbaum
(74) *Attorney, Agent, or Firm*—Michael J. Striker

(57) ABSTRACT

A roller-supported pressure roll for texturing textile machines has a shaft, an outer ring, an elastic covering slip over the outer ring, and a quick-release closure which secures the outer ring by positive engagement to the shaft and can be undone without using tools.

3 Claims, 1 Drawing Sheet

ROLLER-BORNE PRESSURE ROLLER FOR TEXTILE MACHINES, ESPECIALLY TEXTURING MACHINES

BACKGROUND OF THE INVENTION

The invention relates to a roller-supported pressure roll for textile machines, in particular for texturing machines, having an elastic covering that is slipped over an outer ring.

Such roller-supported pressure rolls with an elastic covering for transporting or pulling a yarn in textile machines are already known. The rolls clamp the yarn between a feeder and the rubber covering. If the yarn is to be transported without problems, the rubber covering must be pressed uniformly against the feeder. To assure that the covering is always aligned parallel with the feeder, the bearing of the covering has to have a degree of freedom. This degree of freedom must be relatively great, so that the allowable tolerances in the machine frame between the fastening of the feeder and the fastening of the pivot lever will not become too close. It has therefore been proposed, in German patent disclosure DE 17 60 142 A1, that the pressure rolls be supported in free-floating fashion, so that they can swing back and forth in the plane defined by their axis of rotation and the shaft of the feeder cylinder of the feeder. To that end, the rotary shaft of the pressure roll is secured to a pivotable shaft. This embodiment is relatively expensive, however, because the structural group requires assembly and must installed in a highly precise orientation on the machine. German patent disclosure DE 29 23 871 proposes a pressure roll that is suspended in pendulum fashion from a bolt oriented transversely to the axis of the roll. This embodiment, too, is relatively expensive. Furthermore, the pressure rolls of the prior art cannot be released from the machine, to allow the elastic covering to be reground, without using tools. This regrinding has to be done several times a year, because of wear of the elastic covering. The pressure rolls of the prior art must either be ground along with the shaft, or else the shaft has to be removed in a separate step before the grinding is done.

SUMMARY OF THE INVENTION

The object of the present invention is to propose a pressure roll which is simple in design and can be removed quickly from the machine without using a tool.

With a pressure roll of the type defined at the outset, this object is attained in that the outer ring is secured by positive engagement to the shaft of the pressure roll by means of a quick-release closure that can be undone without using tools. If the covering of the pressure roll has to be reground, it is now possible in a simple way for only the outer ring and the covering to be removed from the shaft and then ground. The outer ring can be clamped directly into the appropriate grinding machine. It is unnecessary to remove the shaft separately. The provision of a quick-release closure also makes the design and installation of the pressure roll simple, because separate fastening means can be dispensed with. The quick-release closure can for instance be formed by a detent connection. It is possible for instance to retain the outer ring by means of an outer cap, which can be snapped into the shaft or into a roller bearing receiving ring of the shaft and which thereby holds the outer ring firmly on the shaft. The quick-release closure can, however, also be a bayonet or screw closure.

Further advantages are attained if the shaft of the pressure roll is embodied in ball-like fashion. Then no separate pivot shaft for suspending the pressure roll in pendulum fashion is needed. By replacing the cylindrical shaft with a shaft embodied in ball-like fashion, there is also less pressure on the pivot bearing per unit of surface area. This version also requires fewer parts and is thus more economical.

A preferred exemplary embodiment of a pressure roll of the invention is described in further detail below, in conjunction with the drawing.

DESCRIPTION OF THE PREFERRED EMBODIMENTS

Figure 2:
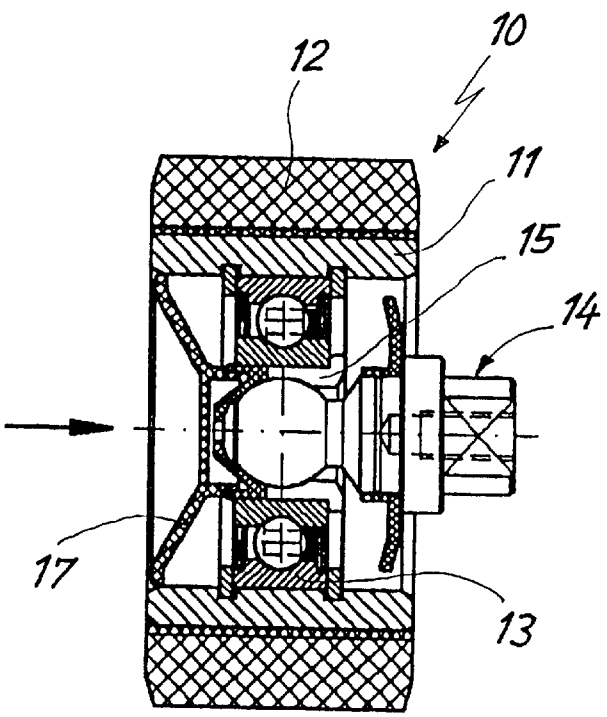
FIG. 2, a section through the installed pressure roll of FIG. 1.
Figure 1:
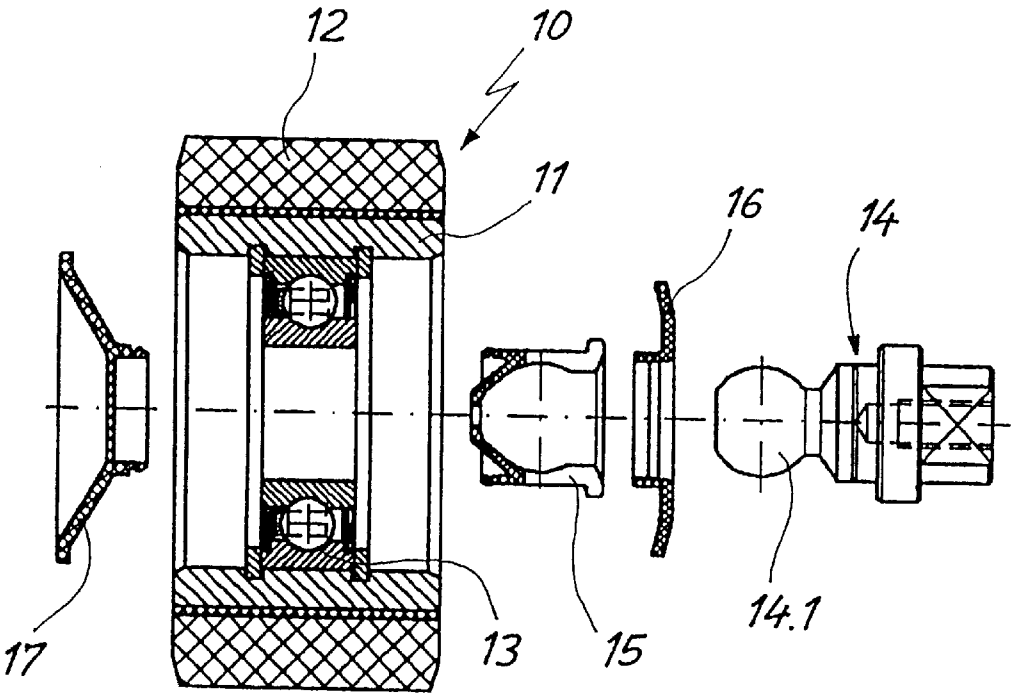
FIG. 1 an exploded view of a pressure roll, seen in section.

The pressure roll 10 of FIGS. 1 and 2 has an outer ring 11, which is covered with an elastic covering 12. A roller bearing 13 is disposed on the inside of the outer ring 11. As FIG. 1 shows, the outer ring 11 along with the covering 12 and the roller bearing 13 can be pulled off a shaft 14 for the pressure roll 10. The shaft 14 has a ball-like portion 14.1, onto which a roller bearing receiving ring 15 can be slipped. To assemble the pressure roll 10, first an inner cap 16 and then the roller bearing receiving ring 15 are slipped onto the shaft 14, before the unit comprising the outer ring 11, covering 12 and roller bearing 13 is pushed onto the roller bearing receiving ring 15. The fixation of the unit comprising the outer ring 11, covering 12 and roller bearing 13 to the shaft 14 is effected by means of a cap 17, which can be snapped into the face end of the roller bearing receiving ring 15, as FIG. 2 shows. The ball-like part 14.1 of the shaft 14 assures that the pressure roll 10 can be aligned to swing parallel to the surface of the feeder; the feeder is not further shown here. Because of the easily released detent connection between the cap 17 and the roller bearing receiving ring 15, the outer ring 11 with the covering 12 can be quickly pulled off the shaft 14 whenever the covering 12 has to be reground because it has worn down. The ensuing installation proves to be simple as well, and like the removal can be done without tools. The roller bearing 13 need not be removed jointly with the outer ring 11 and the shaft. It could also form a unit with the roller bearing receiving ring 15, and then only the outer ring 11 and the covering would have to be designed to be removable. Instead of a detent connection between the cap 17 and the roller bearing 15, a bayonet closure or a screw connection could also be provided.

What is claimed is:

1. A roller-supported pressure roll for texturing textile machines, comprising a ball-shaped shaft; an outer ring; an elastic covering slip over said outer ring; a quick-release closure which secures said outer ring by positive engagement to said shaft and can be undone without using tools, wherein said quick-release closure is formed by a detent connection; and further comprising an outer cap which retains said outer ring and is snappable into said shaft for securing the detent connection between the outer ring and the shaft.

2. A roller-supported pressure roll as defined in claim 1, wherein said shaft has a roller bearing receiving ring; and further comprising an outer cap which retains said outer ring and is snappable into said roller bearing receiving ring.

3. A roller-supported pressure roll as defined in claim 2, wherein said roller bearing receiving ring is composed of plastic.

* * * * *